US005150596A

United States Patent [19]

Hunt et al.

[11] Patent Number: 5,150,596

[45] Date of Patent: Sep. 29, 1992

[54] HEAT TRANSFER FIN WITH DAMMED SEGMENTS

[75] Inventors: Terry J. Hunt, Lockport; Michael A. Breda, East Amherst, both of N.Y.

[73] Assignee: General Motors Corporation, Detroit, Mich.

[21] Appl. No.: 728,419

[22] Filed: Jul. 11, 1991

[51] Int. Cl.[5] ..... B21D 13/04

[52] U.S. Cl. ..... 72/186; 72/379.6

[58] Field of Search ..... 72/185, 186, 187, 379.6, 72/196; 165/152

[56] References Cited

U.S. PATENT DOCUMENTS 3,250,325 2/1963 Rhodes et al. .
3,265,127 10/1963 Nickol et al. .
3,724,538 4/1973 Yamaguchi et al. .
3,993,125 11/1976 Rhodes .
4,469,168 9/1984 Itoh et al. .
4,535,839 8/1985 Sacca .
4,693,307 9/1987 Scarselletta .
4,945,981 8/1990 Joshi .

FOREIGN PATENT DOCUMENTS 0110892 8/1980 Japan .
0104094 6/1984 Japan .

*Primary Examiner*—Lowell A. Larson
*Attorney, Agent, or Firm*—Ronald L. Phillips

[57] ABSTRACT

A flat tube and fin heat exchanger comprises a plurality of tubes arranged in spaced parallelism and a plurality of louvered fins are located between each of the tubes in heat exchange relationship with the tubes. The fins are formed as a series of sinusoidal corrugations defining axial air flow passages in a direction generally transverse to the longitudinal axes of the tubes. A predetermined series of fin panels have louvers formed therein to create turbulence in the axial air flow through the fins. A second series of fin panels are dammed to channel air flow through the tubes so as to maximize heat transfer characteristics of the heat exchanger.

4 Claims, 5 Drawing Sheets

HEAT TRANSFER FIN WITH DAMMED SEGMENTS

FIELD OF THE INVENTION

This invention relates to tube and fin heat exchangers and more particularly to louvered fin arrangements thereof.

BACKGROUND OF THE INVENTION

Various forms of flat tube and fin heat exchangers are known in which the fin (also known as an air center) have various louver or plain fin panel configurations for enhancing the heat transfer efficiency of the heat exchanger by creating turbulence in the air flow therethrough.

U.S. Pat. No. 4,535,839 discloses such a heat exchanger in which the panels of convoluted air centers are pierced in a roll forming process utilizing a first set of forming rollers with teeth configured to receive a strip of roll stock of a desired width and to roll the strip to simultaneously form convolutions and louvers prior to cutting the air center to a desired length. The air center then is reformed to pinch or crush the louvers in the end panels of the air center to close the end panels such that air will not escape through the sides of the heat exchanger. Such reforming, in one case, is performed by directing a cut to length air center through a second set of forming rollers that are configured to engage only the end panels of the air center to pinch louvers therein into a flat or closed position. It has been found that the reflattening step is not totally reliable. Consequently air bypassing at the end panels of the air centers is not completely eliminated. Another proposal has been to direct the louvered convolutions through a set of dies at a cutoff mechanism in order to crush the louvers on either side of either a crest or valley of the convolutions. Such dies are unable to fully crush all of the preformed louvers, and consequently, air bypass is not fully eliminated.

Yet another proposal leaves the end panels of a convoluted air center undeformed with only intermediate panels of the convolutions having louvers formed therein. This proposal is not fully practical since convolutions with louvers are formed in a continuous high speed processing operation and it is difficult to reset the rollers at the ends of the panel to prevent louvering. Furthermore, there is no way to assure registering a cut-off die with at unlouvered panels.

The present invention allows the use of a single set of convolution and louver piercing dies to form dammed panels in the air center for directing air flow through the air centers of a tube and fin heat exchanger so as to improve the heat transfer efficiency of the heat exchanger.

In one aspect, the present invention departs from the structure in the aforedescribed '839 patent by controlling air flow through the air center by selectively damming predetermined panels of a convoluted air center without requiring closure of only the end panels thereof.

In another aspect of the invention a flat tube and fin type heatexchanger has a fin formed with convolutions therein having a predetermined set of adjacent panels formed with louvers therein and with each of a set of adjacent louvered panels being connected to a second set of panels formed without louvers for forming air dams in the convolutions for channeling air flow axially through the air centers.

The present invention also includes a method in which convolutions and louvers are simultaneously formed in selected series of air center panels while generating a periodic dammed panel in the convolutions to axially channel air flow through the air centers of a flat tube and convoluted air center heat exchanger. The method comprises shaping a first plurality of convolutions in a strip of roll stock while simultaneously forming louvers in each of the panels in the convolutions; and periodically shaping a second plurality of convolutions in a strip roll without forming louvers therein.

The present invention in one embodiment includes the method of shaping the dammed panels only at a predetermined spaced ones of the panels in a continuously convoluted strip of roll stock and thereafter cutting the convolutions to a predetermined length so as to include at least two or more dammed panels in the convoluted strip of roll stock.

The present invention, in another embodiment, includes the method of shaping the dammed panels only at a predetermined spaced ones of the panels in a continuously convoluted strip of roll stock while corrugating the dammed panels along their length to reinforce them against crimping and thereafter cutting the convolutions to a predetermined length so as to include at least two or more corrugated, dammed panels in the convoluted strip of roll stock.

A further feature of the present invention is apparatus to form a convoluted fin with louvered panels and uncut dams. The apparatus includes a rotary forming disc set for forming an evaporator fin with a fixed multiple of convolutions and a fixed number of louvered panels on each revolution of the disc set. A preselected number of the teeth on the forming disc are ground flat (in one embodiment every eighth tooth is ground flat on a thirty two tooth forming disc) to prevent the disc set from louvering every nth panel in the convolutions to form a series of spaced air dams for channeling air flow through the evaporator unit.

Still another advantage of the present invention is the provision of apparatus including rotatable discs with cutting teeth and shaping teeth configured to corrugate the dammed panels along their length to reinforce them against crimping.

These and other objects, advantages and features of the present invention will become more apparent from the following description and drawings in which:

DETAILED DESCRIPTION OF THE INVENTION

Figure 1:
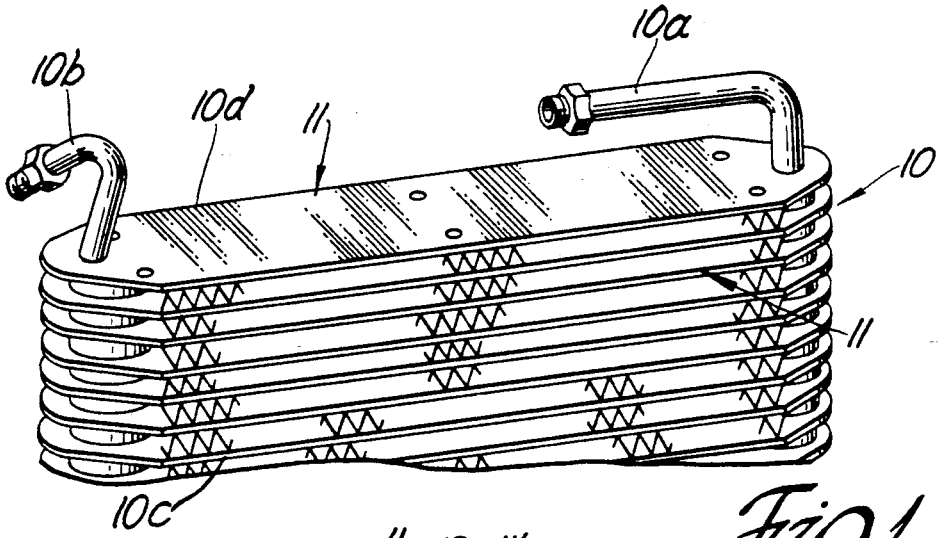
FIG. 1 is a perspective view of a heat exchanger of the plate type having air center strips with air dams of the present invention.
Figure 2:
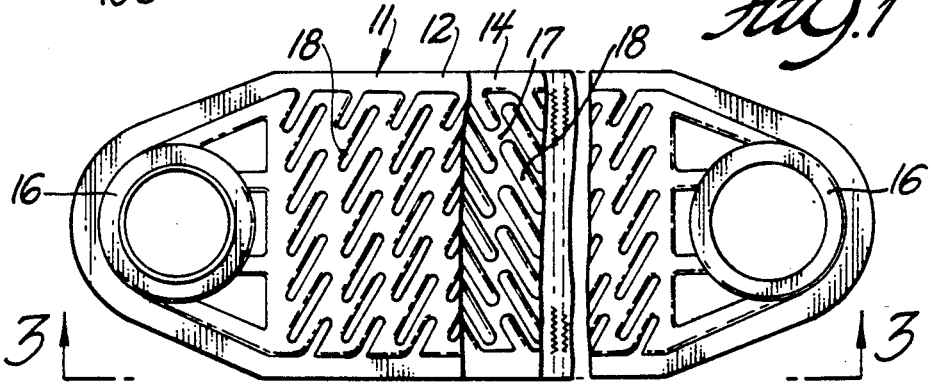
FIG. 2 is a planar view of a heat exchanger of the present invention shown progressively broken away from left to right to expose the air dams in the air center of the present invention.

Referring to the drawings, there is shown a heat exchanger of the plate type adapted for use as a refrigerant evaporator 10 of the type disposed in an inlet air duct of a vehicle air conditioning system. A blower is disposed in the duct to direct air across the evaporator 10 for extracting heat from the air flow in order to cool the air flow for use in conditioning the temperature in a passenger compartment of the motor vehicle.

As seen in FIGS. 1–4, the evaporator 10 comprises a plurality of tube passes 11 each of which includes a pair of plates 12, 14. Each of the plates 12, 14 have a drawn cup 16 formed therein at each end thereof. Each of the drawn cups has a round cross-section and an interconnecting channel configuration 17 includes staggered and overlapping ribs 18. The plate members are configured so that one plate can be inverted and rotated 180 degrees relative to one another to form a number of tube passes with interconnected ends. Additionally, the cups 16 are joined together to space the tube passes 11 apart from one another to form a cavity 20 into which is located a convoluted or corrugated cooling fin or air center 22. The peaks and valleys (crests) 24 of each convoluted fin or air center strip contacts the plates 12, 14 forming the parallel tube passes for flow of refrigerant between an inlet fitting 10*a* and an outlet fitting 10*b* connected in a refrigerant system between a condenser and a compressor as is well known in prior art vehicular air conditioning systems.

Figure 3:
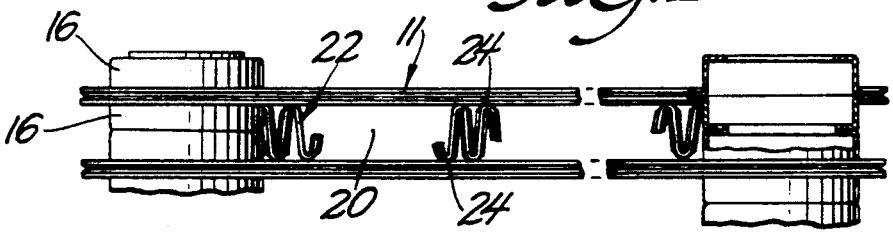
FIG. 3 is an elevational view of two stacked tube passes forming a portion of the heat exchanger in FIG. 1 and looking in the direction of the arrows 3—3 in FIG. 2.
Figure 4:
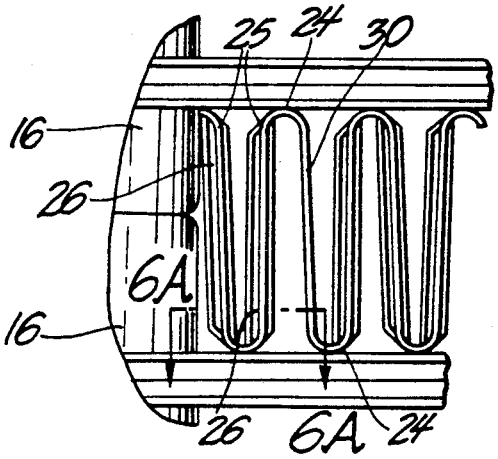
FIG. 4 is an enlarged elevational view of an air dam section in the air center strip in FIG. 3.

Additionally, the air center strip 22 has a plurality of panels 25 formed therein having rows of louvers 26 with the louvers 26 in each panel spaced across the width of the panel 25 and extending across the length of each panel 25 as shown in FIG. 4 so as to provide increased heat transfer relationship of the air with the fins thus formed by the convolution panels 25. The tube plates 12, 14 and the air center strips 22 are brazed or soldered together to form a heat exchanger core which is adapted for use as an evaporator in an air conditioning or refrigeration system having gaseous low pressure refrigerant entering the manifold formed by the interconnected drawn cups 16 as shown in FIG. 3. The plate type heat exchanger thus far described is like that disclosed in U.S. Pat. Nos. 4,470,455 and 4,535,839 which are assigned to the assignee of the present invention and are hereby incorporated by reference.

Figure 5:
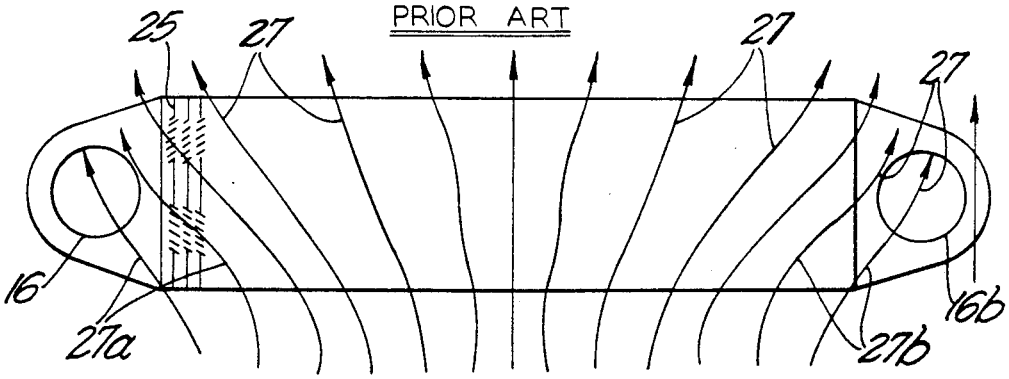
FIG. 5 is a diagrammatic view of air flow through an heat exchanger of the flat tube convoluted fin type in which each of the convoluted fins have louvers therein.

In the '455 patent each of the air center panels 25 have convolutions and as shown in FIG. 5 the blower air flow pattern 27 tends to spread toward the side manifolds 16*a*, 16*b*. As a consequence there is a tendency for a part of the blower air to leak around the manifolds and out the sides of the evaporator 10 rather than being directed completely through the full axial length of each of the panels 25. As a consequence, the escaping air flow at 27*a*, 27*b* will not fully contact the heat exchange surfaces of the heat exchanger core. It has been observed that as much as a five percent loss of cooling effect is attributable to such bypassing.

Figure 6:
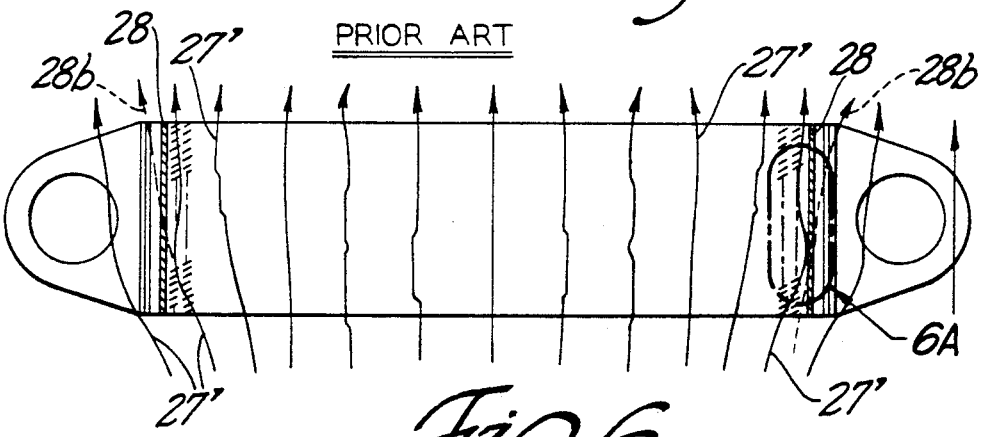
FIG. 6 is a diagrammatic view of air flow patterns through a heat exchanger of the type shown in U.S. Pat. No. 4,535,839.

In the '839 patent the end panels of the convolutions are crushed so that air cannot escape around the side manifolds 16*a*, 16*b*. The resultant air flow pattern 27' is illustrated in FIG. 6, and while suitable for its intended purpose, in practice it has been noted that failure to crush the louvers in end panels 28 can result in an air pattern between that shown in FIG. 6 and that shown in the present invention illustrated in FIG. 7 as shown by the broken line flow streams 28*a*, 28*b*.

Figure 6B:
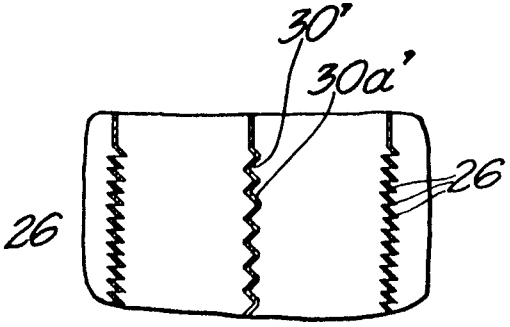
FIG. 6B is an enlarged fragmentary section of an air dam corrugated along its length to reinforce it against crimping.
Figure 6A:
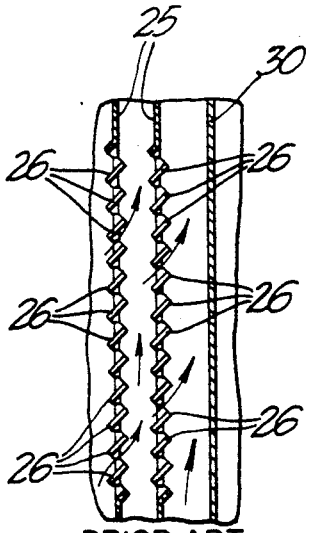
PRIOR ART Fig. 6A
FIG. 6A is an enlarged fragmentary section view of fragment of a cooling fin as circled at 6A in FIG. 6.

In FIG. 6A, a blown-up fragment is included to illustrate the shape of the louvers in each of the panels and the cross-flow of air through the louvers for improving heat transfer therefrom. It should be understood that the louvers in panels shown diagrammatically in FIG. 7 have a similar form and function. Also, while the louvers are formed in the same direction in FIG. 6, it should be understood that the louvers can be arranged either in the same direction or can be formed partly in one direction and partly in another direction, as shown in FIG. 7.

Figure 7:
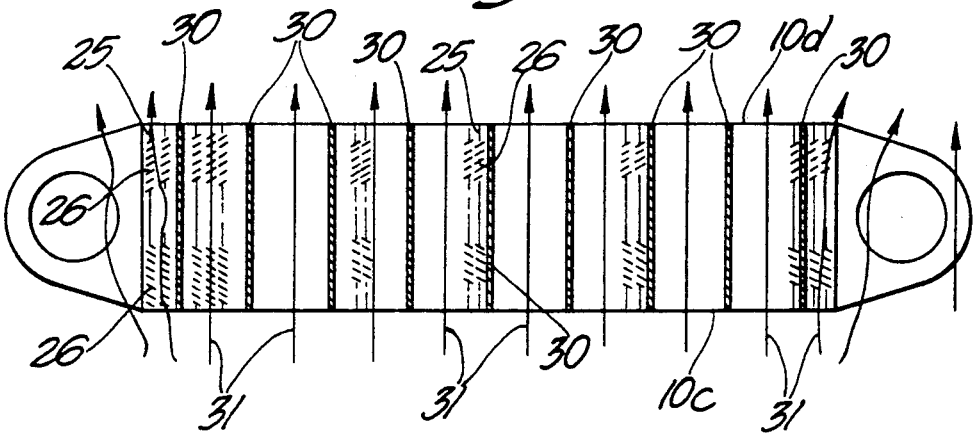
FIG. 7 is a diagrammatic view of air flow patterns through a heat exchanger with the convoluted fin with air dams of the present invention.
Figure 10:
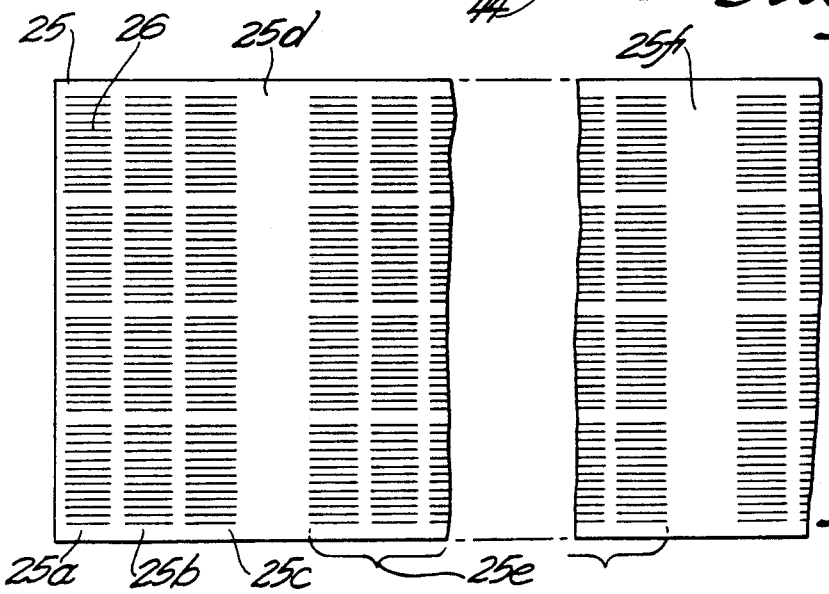
FIG. 10 is a view of a louver pattern formed in by the die disc set of FIG. 8.

A preferred embodiment of the present invention is shown in FIGS. 1–4 and 7 wherein the air centers are formed from a strip of roll stock of desired width through a pair of rotary forming discs to be described that simultaneously form a preselected set of convolutions with panels 25 having louvers 26 and a second set of panels 30 having no louvers therein for defining air dams 30 for channeling air in an axial air pattern 31 through the core of the heat exchanger completely through the core from the front face 10*c* to the rear face 10*d* thereof and also at the sides of the evaporator core 10. As shown in FIG. 7, the air dams in panels 30 are at nth spaced ones of the convolutions in the air center strip as shown in FIG. 10 that is a planar showing of a metal strip prior to the formation of convolutions therein.

While the number of panels having louvers is reduced in the present invention, it has been found that the cooling performance of the evaporator 10 is relatively insensitive to a small change in the number of fins. The channeling of air by the air dams 30 however, assures that the blower air in excess of 90% will be directed fully across the heat transfer surfaces of the core of the heat exchanger comprised of the tube passes 11 and the air centers 22. For example, in one embodiment every 16th panel is unlouvered. In a typical 140 panel air center there are nine (9) dams 30 and even though the spacing of the dams does not conform with closing the end panels of the air center over 90% of the flow is directed through the core. Because of this performance it is not necessary to register the cut-off of the air center at an exact point and accordingly, a strip of roll stock can be continuously directed through one set of rotary forming discs and through a single cutter station so as to meet cooling performance specifications while simplifying the manufacturing process. The rate of production of the air center strip is also increased since there is no need to provide a second follow-up pinching or crushing step to close end panels for preventing air bypass flow.

Figure 8:
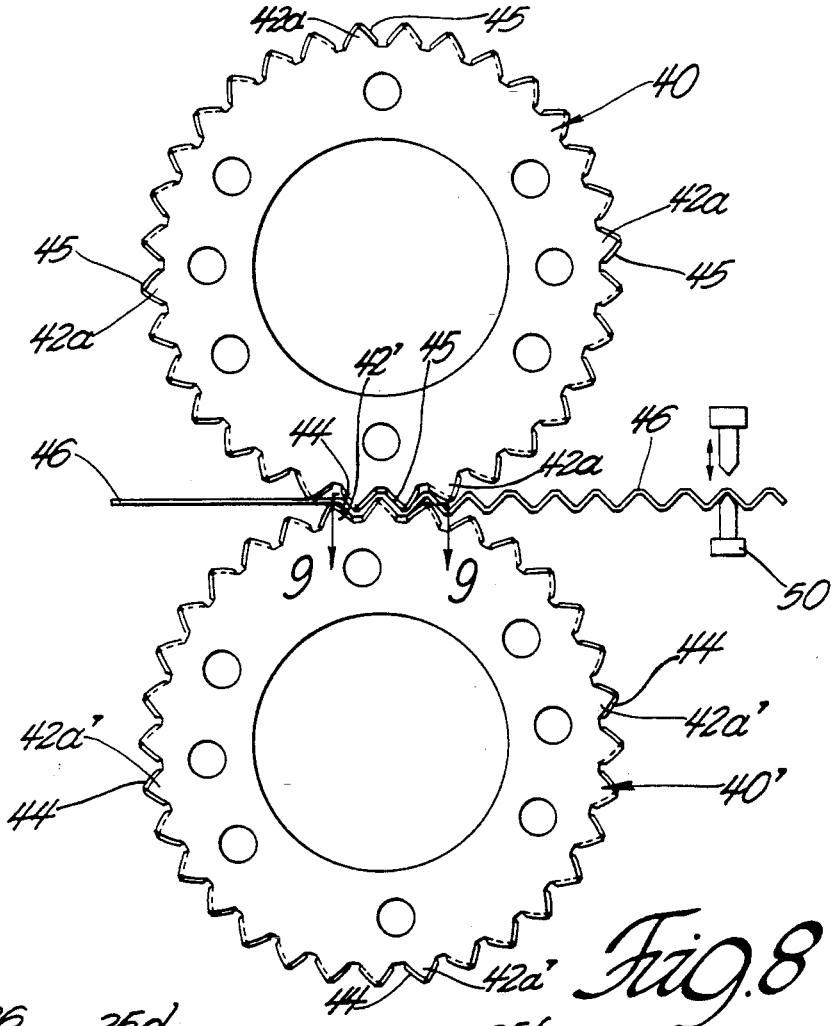
FIG. 8 is a view of a convolution forming die disc set of the present invention.
Figure 9:
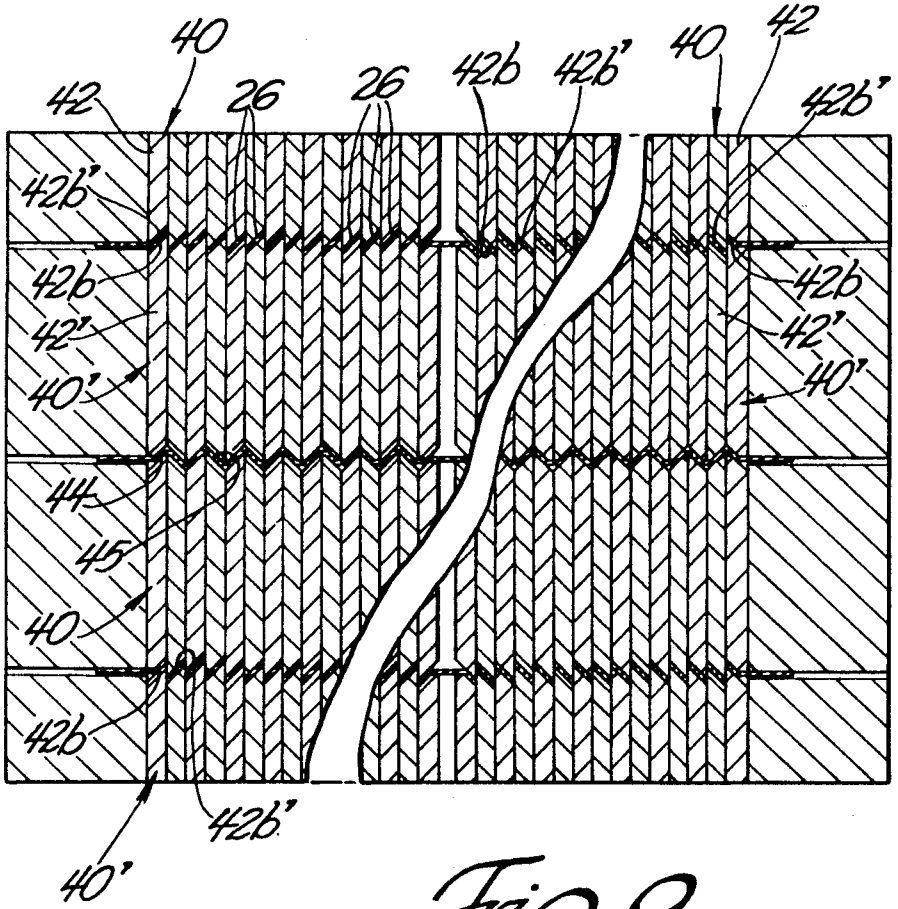
FIG. 9 is an enlarged fragmentary sectional view taken substantially along the line 9—9 of FIG. 8 showing how louvering teeth and corrugated teeth thereon are meshed.

Referring now to FIG. 8, a pair of rotatable arbors made up of stacked discs 40, 40' each having thirty-two (32) teeth 42, 42' for forming the louvers 26 in each of the panels 25. In the embodiment of FIG. 8, the leading edge 44 of every eighth tooth 42*a'* on the disc 40' and the trailing edge 45 of like teeth 42*a* on disc 40 are ground such that on rotation of the discs 40, 41 every 16th panel will be an uncut dam. FIG. 9 is a fragmentary sectional view generally taken along line 9—9 of FIG. 8 when rotated to engage teeth 42, 42' and 42*a*, 42*a'*. In order to prevent cutting of the convolutions as the flat roll stock exits the discs 40, 40', the surfaces 44, 45 are ground to remove knife edges 42*b*, 42*b'* formed on teeth 42, 42' which are shown in the fragmentary sectional view of FIG. 9 diagrammatically illustrating the manner in which louvers 26 are cut in the panels 30. The ground surfaces 44, 45 are not ground flat but rather, as shown in FIG. 9, are ground in a corrugated shape along their lengths to form an uncut dammed panel 30' which is reinforced by corrugations 30*a'* along its length to support the panel 30' against buckling or crimping. This embodiment is shown in FIG. 6B where the corrugations 30*a* are shown along the length of an uncut or unlouvered dam 30'. While the FIG. 7 embodiment shows straight dams 30, it is to be understood that the corrugated version of FIG. 6B is preferred.

Figure 11:
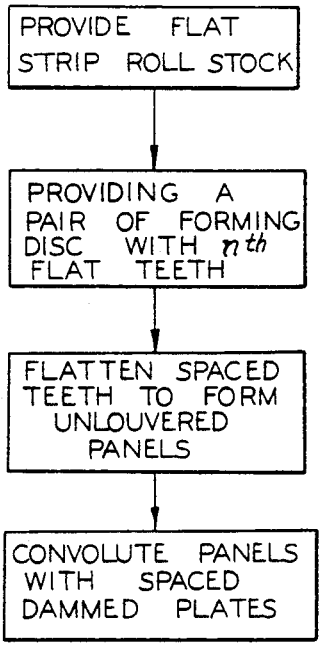
FIG. 11 is a flow chart of the method of the present invention.

The rotary forming discs 40, 41 provide the tooling for practicing the method shown in the chart of FIG. 11. The method of the present invention includes the steps of providing a strip of flat roll stock 46 having a desired width; providing a pair of forming discs 40, 41 to have a predetermined number of teeth to form a selected number of convolutions and panels per one revolution; flattening spaced ones of the teeth on the forming disc to produce a first predetermined series of louvered panels interposed by a plurality of unlouvered panels for forming a sufficient number of air dams for maintaining an axial air flow retention percentage in the range of 90%-95% of the total air flow through the evaporator and determining the spacing of the flattened teeth, dividing the total number of air center panels by a divisor which will limit the number of louvered panels at the end of air center strip so as to maintain a full axial air flow retention percentage in the range of 90%-95% of the total air flow through the core of the heat exchanger.

In one embodiment useful for forming air center strips 22 for use in evaporators, a typical strip has 140 convolutions formed therein. In order to produce the desired air flow retention range, each 16th panel is unlouvered. In one working embodiment, to obtain such a louver pattern which is shown in FIG. 9, the evaporator forming disc has 32 teeth which gives 64 panels per revolution of the disc set. In order to produce a desired pattern by grinding the leading edge of given teeth on the disc, it is desirable to use a divisor of 64. If either every 32nd or 64th panel were to be unlouvered, there would be too many louvered panels at the end of the strip which would result in too much bypassing of air flow around the heat transfer surfaces of the core (the degree of bypass would appear like one half or more of the bypassing in the fully louvered panel arrangement shown in FIG. 5). At the other extreme, damming every 8th panel would increase the number of unlouvered panels in each center to significantly reduce the heat transfer capacity of the core. Accordingly, in the illustrative embodiment the divisor is selected as every sixteenth panel which will result in nine dams that will produce an air flow channeling within the desired range.

Moreover, the selection of an unlouvered panel at every sixteenth panel enables a cutoff die 50 to cut the convoluted strip without having to register the cut off die with any particular point or without cutting away waste segments of the convoluted strip. For example, as shown in FIG. 10, the cut could occur at a point where three louvered panels 25*a*, 25*b* and 25*c* are located at the end of the air center strip 22. These panels 25*a*-25*c* are followed by an unlouvered panel 25*d* and the fifteen louvered panels 25*e*, a unlouvered panel 25*f* with the pattern being repeated for the full 140 panel air center.

Figure 12:
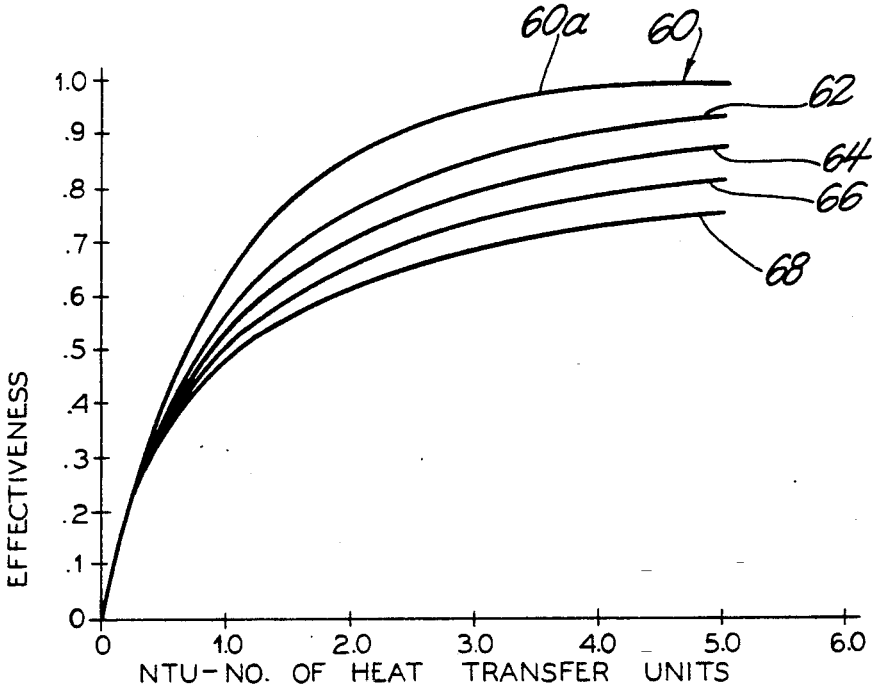
FIG. 12 is graph showing the heat transfer effectiveness of a heat exchanger with and without the air dams of the present invention.

As shown in FIG. 12, a heat exchange effectiveness chart in terms of NTU, e.g., Number of Transfer Units, is shown. A preferred characteristic curve for an evaporator center is $C^*=0.0$. This curve shown at reference numeral 60 indicates the evaporator's performance as a function of the number of effective heat transfer fins when all of the fins are louvered. The flattened portion 60*a* of the curve 60 shows the effectiveness to be between 0.9 and 1.0 depending upon the number of transfer units (NTUs). When a greater number of fins are unlouvered the effectiveness is only slightly lowered as shown by curves 62-68. The slight reduction in performance due to the loss of a few of the louvers in the dams is offset by an increase in the directional control of flow through the core as described herein. Furthermore, the use of spaced dams 30 controls sufficient flow such that the presence of louvered panels 25*a*-25*c* at the end of the air center will not adversely affect heat exchange performance attributable to the spaced dams 30.

While the use of unlouvered panels in convoluted air centers has been described with respect to a refrigerant evaporator the use of such an air center is applicable to other heat exchanger types including condensers and radiators used in automotive air conditioning systems and engine cooling systems respectively. The above described preferred embodiment of the invention are illustrative of the invention with it being understood that modifications thereof may be made within the scope of the appended claims.

What is claimed is:

1. In a method for forming an air center for a tube and convoluted fin heat exchanger in which a flat strip of roll stock is directed through a pair of rotatable forming discs the steps of:

preshaping the pairs of forming discs to have a series of convolution forming and louver cutting teeth; shaping intermittent ones of cutting teeth to form a dammed convolution panel in the roll stock directed therethrough;

rotating the discs for forming first and second series of convoluted panels in the roll stock having louvers while generating a periodic dammed panel in the convolutions.

2. In a method for forming an air center for a tube and convoluted fin heat exchanger in which a flat strip of roll stock is directed through a pair of rotatable forming discs;

preshaping the pairs of forming discs to have intermittent cutting teeth shaped to form convolutions without cutting louvers in the roll stock directed therethrough;

rotating the discs for forming first and second series of panels having louvers while generating a periodic dammed panel in the convolutions for channeling of air flow through the air centers of a flat tube and convoluted air center heat exchanger; and shaping a first plurality of convolutions in a strip of roll stock while simultaneously forming louvers in each of the first and second series of panels in the convolutions; and periodically shaping a second plurality of convolutions in a strip roll without forming louvers therein.

3. In a method for forming an air center for a tube and convoluted fin heat exchanger in which a flat strip of sheet stock is directed through a pair of rotatable forming discs;

providing the pairs of forming discs with cutting teeth shaped to form louvers in the sheet stock directed therethrough;

providing intermittent teeth on the forming discs to form convolutions without cutting louvers in the sheet stock; and rotating the discs with respect to the sheet stock for forming first and second series of panels having louvers while generating a periodic uncut dammed panel in the convolutions for channeling of air flow through the air centers of a flat tube and convoluted air center heat exchanger.

4. In a method for forming an air center for a tube and convoluted fin heat exchanger in which a flat strip of sheet stock is directed through a pair of rotatable forming discs;

providing the pairs of forming discs with cutting teeth shaped to form louvers in the sheet stock directed therethrough;

providing intermittent teeth on the forming discs to form convolutions without cutting louvers in the sheet stock;

rotating the discs with respect to the sheet stock for forming first and second series of panels having louvers while generating a periodic uncut dammed panel in the convolutions for channeling of air flow through the air centers of a flat tube and convoluted air center heat exchanger; and providing the intermittent teeth with a corrugated shape along their length; and shaping a second plurality of corrugations in the uncut dammed panel during rotation of the discs.

* * * * *